US006019358A

United States Patent [19]

Bernstein

[11] Patent Number: 6,019,358

[45] Date of Patent: Feb. 1, 2000

[54] WORKHOLDING WEDGE BLOCK WITH CHIP SHIELD

[75] Inventor: Leon M. Bernstein, Minnetonka, Minn.

[73] Assignee: Kurt Manufacturing Company, Inc., Minneapolis, Minn.

[21] Appl. No.: 09/141,404

[22] Filed: Aug. 27, 1998

[51] Int. Cl.[7] ..... B25B 1/12

[52] U.S. Cl. ..... 269/137

[58] Field of Search ..... 269/134–138, 269/246

[56] References Cited

U.S. PATENT DOCUMENTS

| | | | |
|---|---|---|---|
| 4,049,253 | 9/1977 | Mandel | 269/137 |
| 4,804,171 | 2/1989 | Dornfeld . | |
| 5,324,013 | 6/1994 | Marino | 269/137 |
| 5,442,844 | 8/1995 | Swann . | |
| 5,718,420 | 2/1998 | Bernstein . | |

*Primary Examiner*—Robert C. Watson

*Attorney, Agent, or Firm*—Westman, Champlin & Kelly, P.A.

[57] ABSTRACT

A wedge lock workholder for holding workpieces on a machine tool table has a wedge block that has a bore positioned at an angle relative to the support for the wedge block. A wedge slide is slidably mounted in the bore. The angle of the bore provides lateral movement of the wedge slide as the wedge slide is moved along the bore in the wedge block. The wedge slide has a chip shield that slides in a slot in the wedge block to protect the bore opening from entry of chips, and which chip shield serves as a guide for positioning the wedge slide properly. The wedge slide carries a workpiece engaging jaw member at an upper portion thereof which exerts a lateral force on a workpiece to clamp the workpiece against a stop or other clamping member.

18 Claims, 5 Drawing Sheets

WORKHOLDING WEDGE BLOCK WITH CHIP SHIELD

BACKGROUND OF THE INVENTION

The present invention relates to a compact workholding wedge block that is used for clamping and holding workpieces on a machine tool table, which has a minimum number of parts and which is easily operated for locking action. The wedge block has side shields that exclude chips from the moving parts.

Various compact workholding clamps have been advanced for workholding systems where a multiple number of parts are mounted onto a machine tool table or pallet using wedge clamping principles. A wedge clamp is shown in U.S. Pat. No. 4,804,171. The wedge is pressed against opposite sides of a U-shaped frame or holder to provide lateral clamping force to clamp a part against a fixed support or jaw.

Additionally, U.S. Pat. No. 5,718,420 shows a workholding wedge clamp that has a clamp body adapted for mounting on a table. A wedge acts against a jaw to move the jaw to clamp a workpiece, and a resilient member provides a biasing force to release the jaw when the wedge is loosened.

The wedge clamp shown in U.S. Pat. No. 5,718,420 does have shields for shielding the moving parts from chips.

SUMMARY OF THE INVENTION

The present invention relates to a workholding wedge block forming a clamp assembly that is made with a minimum number of parts and has an effective chip shield that shields the movable members and actuating screw from chips, and provides adequate clamping movement to hold workpieces relative to a machine tool table. The assembly includes a wedge block that mounts onto a tool table and which is fixed in position. A wedge slide is supported on a wedge surface of the wedge block that is angled relative to the plane of a supporting table. The wedge slide is moved along the wedge surface using a screw that threads into the wedge block and passes through the wedge slide. The wedge slide slides along the wedge surface of the wedge block at an angle relative to the workpiece so that as the slide moves toward the supporting table a lateral component of movement provides a clamping action that forces the wedge slide against a workpiece.

In one form of the invention the wedge drive screw is double acting so the distance moved for each revolution of the screw is twice that of a single screw.

The wedge slide is compact, and is quite easy to machine. The wedge slide includes chip shields that fully shield the moving parts to prevent chips from falling into the actuating mechanisms and causing problems during tightening.

DETAILED DESCRIPTION OF THE PREFERRED EMBODIMENTS

Figure 1:
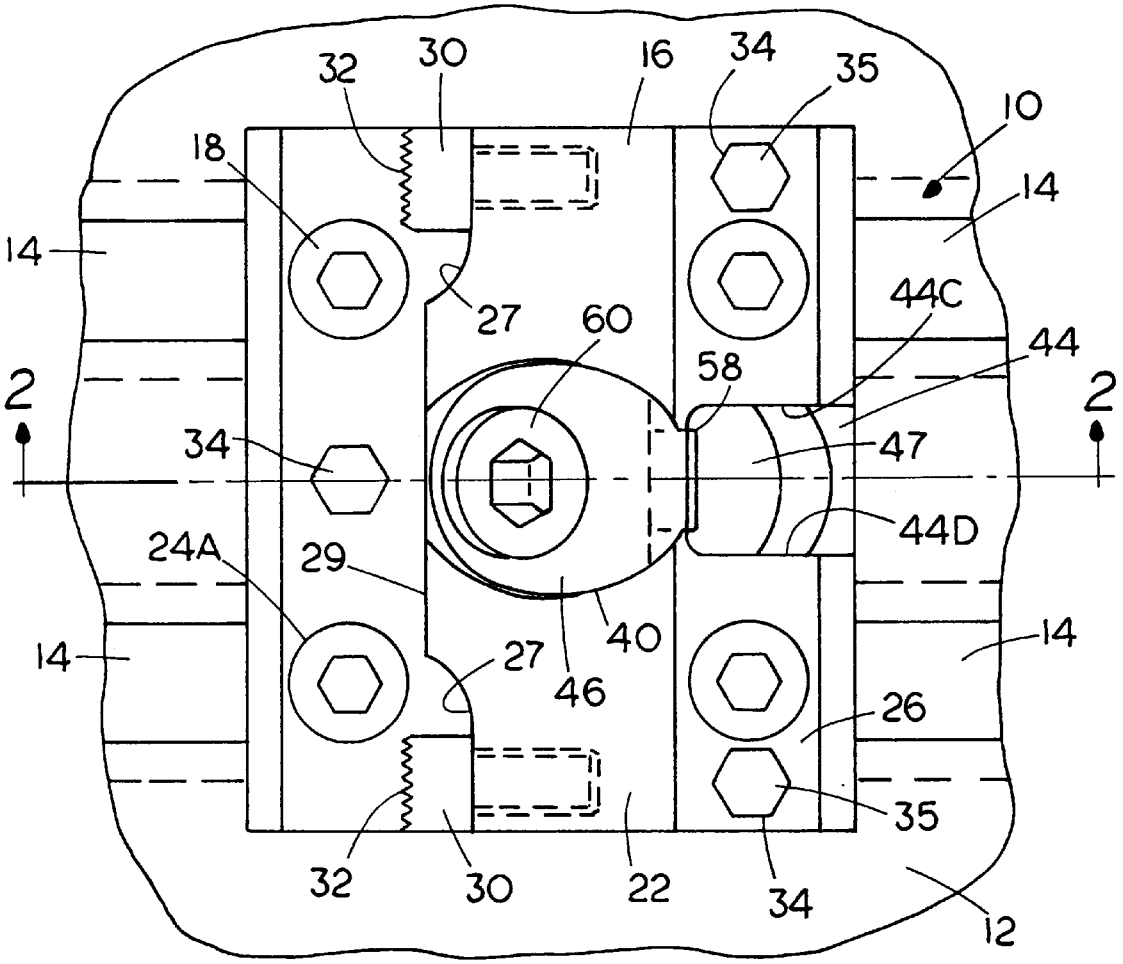
FIG. 1 is a top plan view of a workholding wedge clamp assembly made according to the present invention mounted on a machine tool table.

The workholding wedge clamp assembly shown generally at 10 is mounted onto a machine tool table 12 that has conventional T-slots 14 therein for supporting and holding parts or workpieces that are clamped in place for machining, drilling and the like.

The workholding wedge clamp 10 of the present invention includes a wedge block 16 that forms a base having a base support plane 17 resting on the surface of the tool table 12. The wedge block 16 is provided with a plurality of openings through which cap screws 18 extend. The cap screws 18 also pass through the top gap in the T-slots 14 and one or more of the wedge clamp blocks are clamped relative to the table using suitable nuts 20 or threaded plates that are positioned in the T-slots 14 and threadably receive the cap screws 18. The heads of cap screws 18 are recessed into the wedge block 16. The wedge block 16 has a cross boss or rib 22 in the center thereof, formed by inwardly extending shoulder surfaces 24 and 26. Workpieces such as that shown schematically at 28 in FIG. 2 on opposite sides of the rib 22, overlie the shoulder surfaces when the workpieces are in position for clamping.

Figure 2:
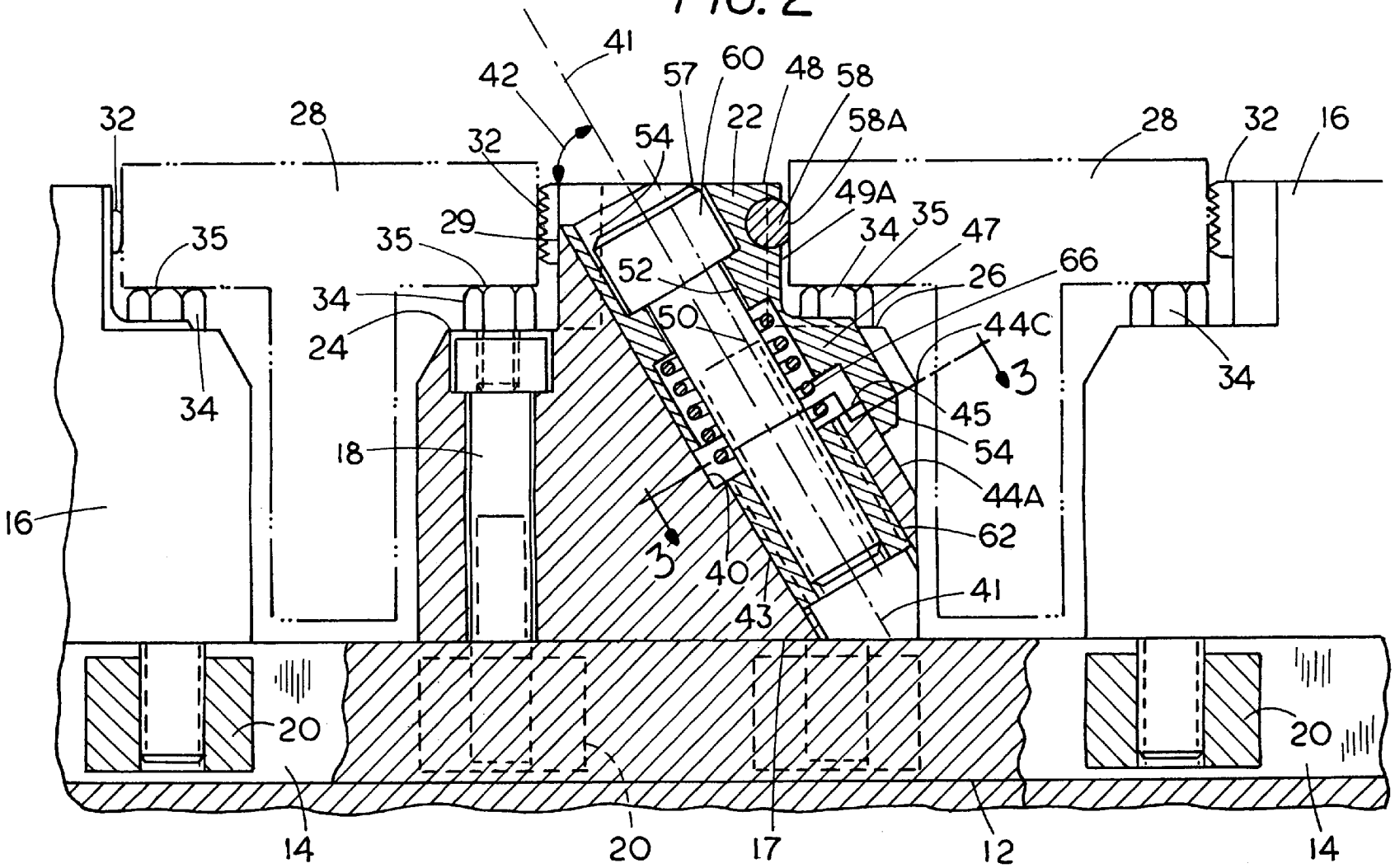
FIG. 2 is a sectional view taken on line 2—2 in FIG. 1.
Figure 3:
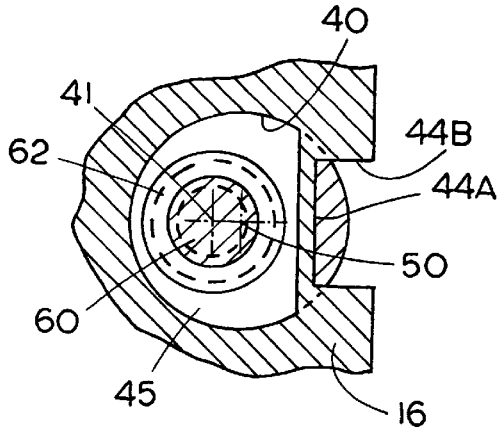
FIG. 3 is a sectional view taken on line 3—3 in FIG. 2.
Figure 4:
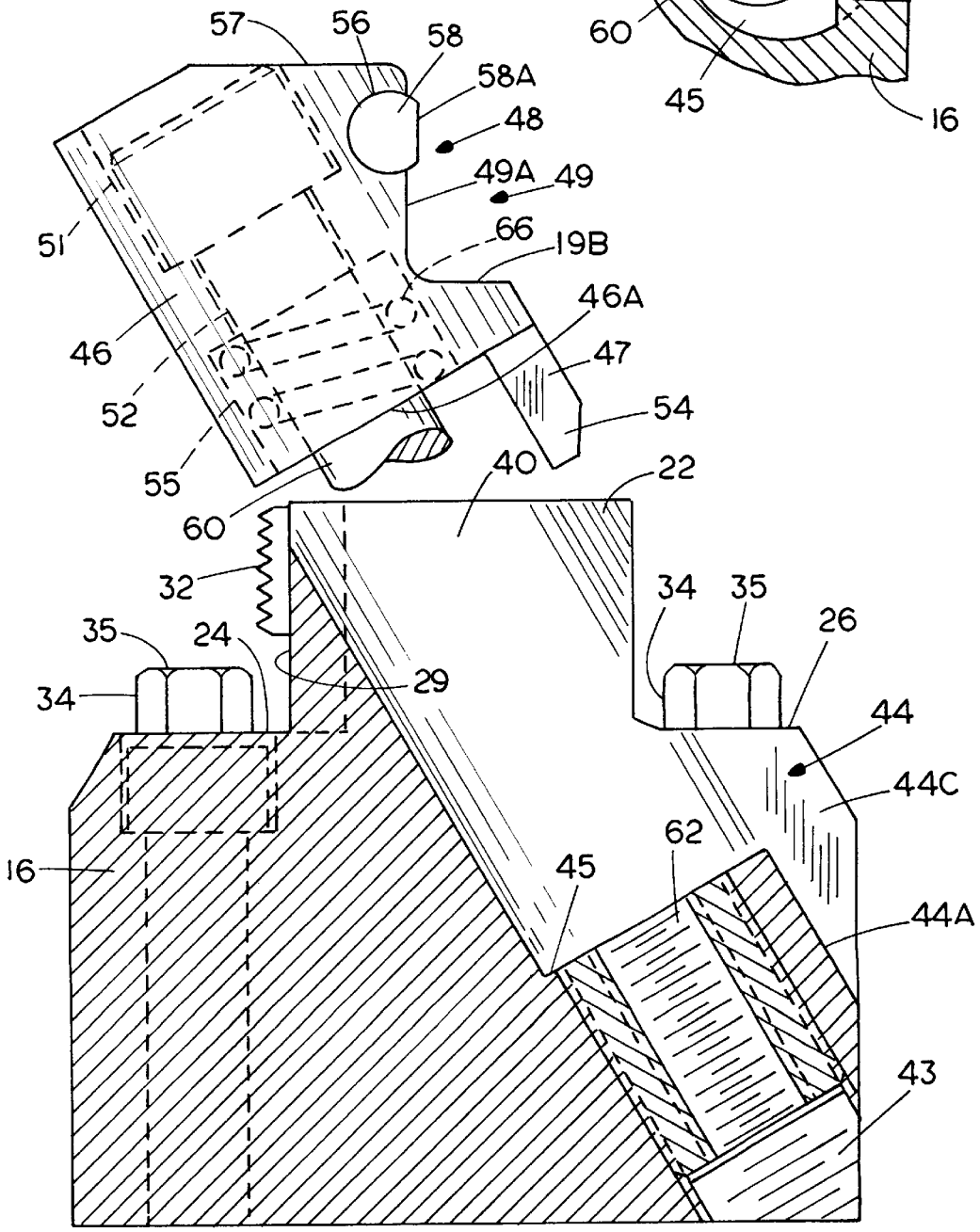
FIG. 4 is an exploded view including a sectional view of a wedge block as shown in FIG. 2, with a wedge slide in position to be inserted into a slide bore of the wedge block.

In this form of the invention, one side surface 29 of the boss or rib 22 may have recesses or reliefs 27 adjacent the opposite ends of the boss. Vertical surface stop screws are threaded into the side of the rib 22 in the recesses 27 and the vertical surface stop screws have heads 30 that have serrations 32 on their outer ends. The serrations and a portion of the vertical surface stop screw head extend outwardly beyond the plane of side surface 29 of the rib 22 so that the workpiece 28 on that side of the wedge block 16 will be engaged by both of the serrated heads 32 for gripping and holding a workpiece urged against the vertical surface stops by a clamping force at one point from an adjacent wedge clamp. The shoulder surfaces 24 and 26 are parallel to the top of the table 12. Locating pads 34, which have upper horizontal head surfaces 35, support horizontal surface portions of the workpiece at three points, are threaded into the surfaces 24 and 26. The locating pad head upper surfaces 35 are shown in FIGS. 1, 2 and 4. There is one of the locating pads 34 in the shoulder surface 24 on one side of the rib 22 and two locating pads 34 on the shoulder surface 26 on the other side of the rib 22. These three locating pads provide three point support for the workpiece with two locating pads 34 on one side of the workpiece and one on the other.

Wedge block 16 has a large cylindrical bore 40 extending from the top of rib 22 downwardly at an angle relative to the base surface support plane 17 of the wedge block 16. The wedge block 16 rests on the top surface of the tool table 12. The centerline of the bore 40 is shown at 41, and is positioned at an acute angle relative to the base of the wedge block. When the wedge block 16 is installed on a tool table, the centerline of bore 40 is thus also at an angle relative to the top plane of the tool table 12. The angle, which is indicated at 42, is a wedge angle for the wedge clamp, and preferably is between 20° and 40°.

The upper part of bore 40 intersects the side of the rib 22 to form an opening at the side of the rib 22. The upper part of bore 40 ends at an end shoulder surface 45. There is a smaller diameter bore section 43 adjacent to the base of the wedge block 16 also formed about axis 41. The wedge block 16 has a guide slot 44 cut therein on one side with a base surface 44A also extending at the wedge angle, so surface 44A is parallel to the axis 41 of bore 40. The slot 44 has parallel side surfaces 44C and 44D and intersects the bore 40 below the rib 22. Thus the bore 40, above the shoulder surface 45, is open laterally to the exterior of the wedge block. The guide surface 44A extends below the shoulder 45 toward the tool table 12.

A workholding wedge slide indicated generally at 48 (see FIG. 7 also) is formed from a large cylindrical rod that slidably fits into the bore 40, and which has a central axis 50.

Figure 5:
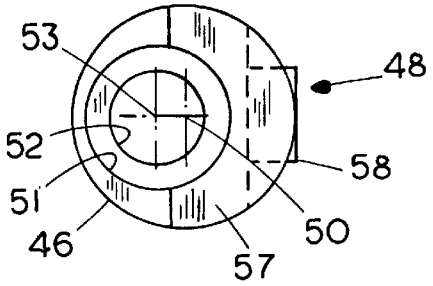
FIG. 5 is a top view of the wedge slide of FIG. 4.
Figure 6:
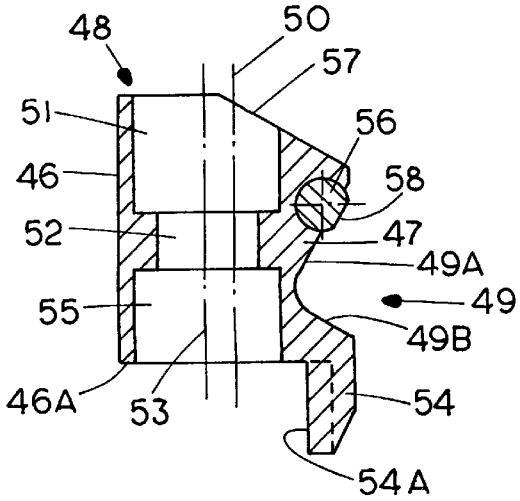
FIG. 6 is a sectional view of a wedge slide used in the clamp of FIG. 1.
Figure 7:
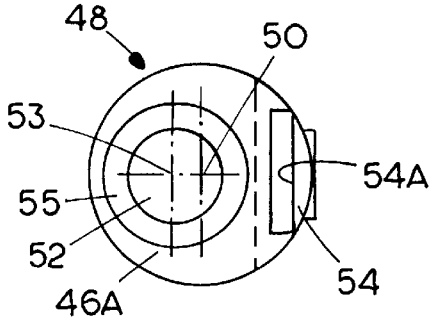
FIG. 7 is a bottom plan view of the wedge slide of FIG. 5.

The wedge slide 48 is machined to be an irregular shape in side view. When the wedge slide is made, a guide key 47 is formed to extend below an end surface 46A to one side of the cylindrical rod. As can be seen in FIGS. 5, 6 and 7 for example, the center axis 50 is the axis of the large cylindrical rod and of a cylindrical guide shank 46. An actuator screw bore 52 is provided through the guide shank 46 on an axis 53 offset from the axis 50. The axis 53 and the axis 41 coincide when the wedge slide 48 is placed in bore 40. The bore 52 has a countersunk bore portion 51 at the top end thereof, which is of size to receive the head of a cap screw, as is shown, and also has a countersunk bore at a lower end forming a pocket 55 which will receive a return spring for the wedge slide 48.

A laterally indented recess 49 is formed in the outer side of the key 47 and is formed in an "L" shape with one surface 49A positioned at an angle relative to the axis 50 that is the compliment of the angle shown at 42, relative to axis 50. Thus, when the wedge slide 48 is placed in the bore 40, the surface 49A is perpendicular to the base support plane 17 of the wedge block 16 along the top of the tool table 12.

The key 47 of wedge slide 48 has a depending end forming a chip shield 54 that it extends into the slot or guideway 44. The chip shield 54 has a surface 54A that slides along the surface 44A when the wedge slide 48 is positioned in the bore 40 of wedge block 16. The key and chip shield 54 functions to keep the wedge slide 48 from rotating and to protect the screw used for clamping from foreign material, usually in the form of chips from the workpiece.

The surface 49B, which is formed by recess 49 and joins surface 49A, is formed to have offsets as needed for clearance in operation. A bore 56 having an axis forming a chordal line on the cylindrical shank 46 is provided near an edge of an end surface 57 and opens to the recess surface 49A. Cross bore 56 receives a clamp jaw pin 58. The pin 58 has a flat side 58A and can rotate in the cross bore 56 to self align when the flat side engages a workpiece 28 as shown in FIG. 2.

A wedge slide screw 60 is passed through the bore 52 of the wedge slide 48, and with the wedge slide 48 in the bore 40, the wedge slide screw 60 extends down so that its threaded end threadably engages a threaded sleeve 62. Sleeve 62 has external threads which are threaded into and locked in place in threads in bore portion 43 of the wedge block 16. A coil spring 66 is positioned around the wedge slide screw 60 and fits into the spring pocket 55 of the wedge slide 48. The spring 66 abuts the shoulder surface 45 of the bore 40 and the end surface of the pocket 55 to provide a biasing force tending to move the wedge slide 48 upwardly as shown in FIG. 2. Thus, because of the inclination of the bore 40 for the wedge slide, the spring urges the wedge slide away from the shoulder surface 45 and away from a workpiece 28 that is facing the pin 58.

The flat side of clamp jaw pin 58 extends out beyond the side of rib 22 a sufficient distance for engaging a workpiece before surface 46A is close to surface 45, (see FIG. 2) so the wedge slide can be moved downwardly for clamping. Jaw pin 58 forms one short line of contact on one side of a workpiece to clamp the workpiece around the two stops 32 to properly locate the workpiece. Several wedge block assemblies 10 can be arranged along T-slots 14, on a tool table 12. The wedge block assemblies 10 can be used for clamping several workpieces in position generally as shown in FIG. 2. The key 47 and shield 54 slides in the slot 44 formed on the wedge block 16, and keeps chips from entering the bore 40. It can be noted that the wedge slide 48 is trimmed along surface 57 so that it does not protrude upwardly substantially beyond the top of the rib 22 when the slide is in a released position. Also, the angle shown at 42 is selected so that horizontal components of travel for clamping a workpiece is adequate so that only a short turn of the actuator cap screw 60 will provide needed movement for locking a workpiece in position. The unlocking movement is a reversal of the locking movement.

Figure 9:
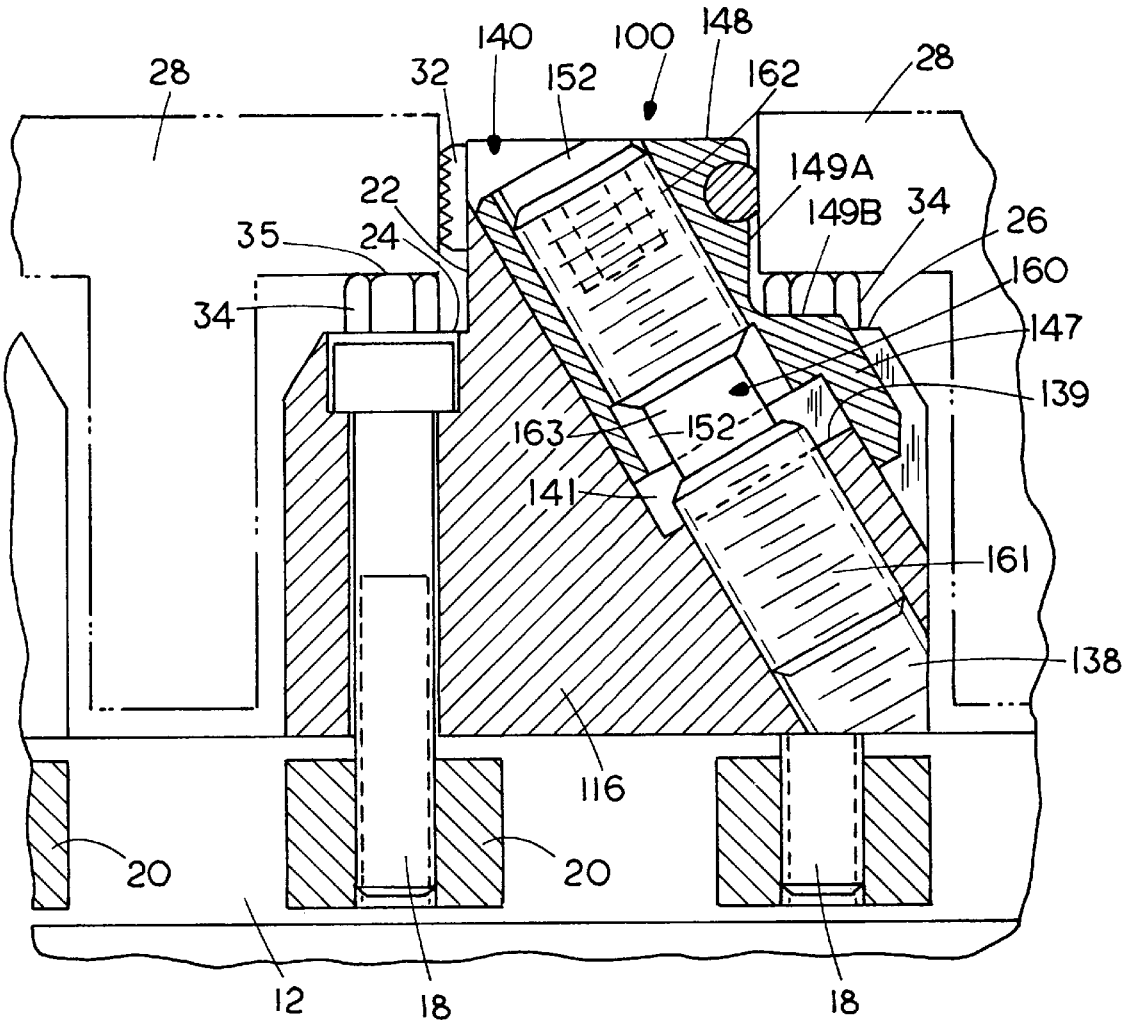
FIG. 9 is a sectional view similar to FIG. 2 showing a modified form of the wedge screw.

FIG. 9 shows a modified wedge block and lide assembly 100 that operates in substantially the ame manner as the first form of the invention, and uses the same principles of operation. The same parts carry the same numerals as in the first form of the invention. A wedge block 116 forms a base that rests on a surface of the tool table 12. Cap screws 18 hold the wedge block in place as shown previously. The wedge block 116 has the cross rib 22 in the center as well as the inwardly extending shoulder surfaces 24 and 26. The workpieces 28 are also shown for an example of how the form of the invention in FIG. 9 operates. The work piece supports and locators are the same as in the first for of the invention.

Figure 8:
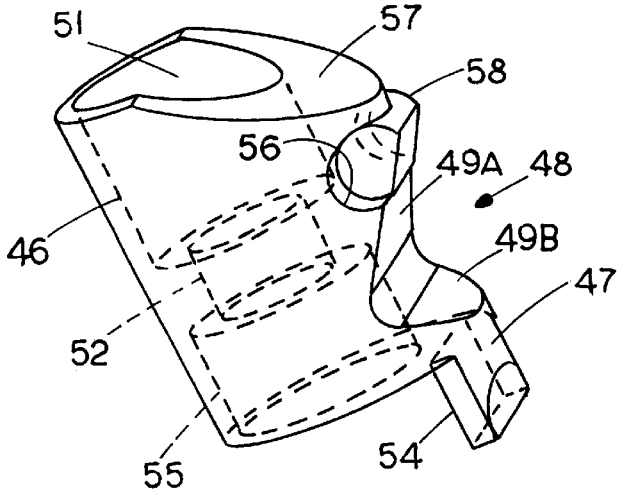
FIG. 8 is a perspective view of the wedge slide of FIG. 5.

In this form of the invention there is a bore 140 that is formed in the wedge block 116 with a center axis at an angle relative to the top plane of the tool table 12. The angle of inclination is the wedge angle. In this form of the invention, the lower bore portion 138 of the bore is threaded with internal threads. The upper portion 141 of the bore 140 receives a workholding wedge slide 148 which is a cylindrical rod the is formed in the same shape externally as the showing in FIG. 8.

The wedge slide 148 includes the guide key 147 that slides in a slot 144 in the wedge block. The key 147 is recessed at the top with surfaces 149A and 149B formed as in the first form of the invention.

In this form of the invention the wedge slide has a bore 152 that is internally threaded with threads of opposite hand or lead from the threads in the bore portion 138 in the wedge block. When the wedge slide 148 is in place in the bore portion 141, the axis of the threaded bore portion 138, bore portion 144 and bore 152 are coincident. A shoulder 139 is formed between bore portions 138 and 141. In this form of the invention a wedge slide actuator screw 160 is provided with two threaded section, including a section 161 that threads into the internal threads in bore portion 138 and a threaded section 162 that threads into the bore 152. The threads on the screw section 161 are right hand threads to match the threads in bore portion 138 and the threads on the screw section 162 are left hand threads, to match the threads in bore 152 of the wedge slide 148. A central unthreaded section 163 is provided between threaded screw sections 161 and 162 of screw 160. The screw 160 is a socket head screw and can be operated with an Allen wrench, as in the first form of the invention. Since the threads in bore 138 and the bore 152 in the wedge slide 148 are of opposite hand or lead, the movement of the wedge slide 148 relative to the wedge block 116 is doubled for the same rotational movement of the screw 160, as compared to the slide movement in the first form of the invention using a single threaded screw section and return spring. Thus, the form of the invention shown in FIG. 9 provides for more rapid clamping and loosening of the workpieces, but otherwise operates in the same manner as in the first form of the invention.

Although the present invention has been described with reference to preferred embodiments, workers skilled in the art will recognize that changes may be made in form and detail without departing from the spirit and scope of the invention.

What is claimed is:

1. A workholder including a wedge block having a bore therein positioned with an axis of the bore at an acute angle relative to a base support plane of the wedge block, the bore having a bore shoulder within the wedge block;

a guide slot formed in said wedge block to provide guide surfaces, said guide slot intersecting said bore along one side of the bore;

a wedge slide slidably mounted in said bore and having a jaw for engaging a workpiece, and having a chip guard section slidable in the guide slot, said chip guard section having a length to shield the shoulder of said bore during operative travel of the wedge slide; and an actuator to move said wedge slide in said bore toward the base support plane, said jaw of the wedge slide engaging a workpiece on the exterior of said wedge block and providing a lateral clamping force on a workpiece engaged by the wedge slide as the wedge slide slides in said bore toward the bore shoulder.

2. The workholder of claim 1 and a spring for urging the wedge slide away from the bore shoulder.

3. The workholder of claim 2 and wherein the actuator comprises a screw passing through an opening in said wedge slide and threadably engaging a threaded opening in the bore shoulder to provide a force urging the wedge slide toward the bore shoulder.

4. The workholder of claim 1 wherein the actuator comprises a screw having a first threaded section threadably engaging a threaded opening between the bore shoulder and base support plane and having a second threaded section threaded into an aligning bore in the wedge slide, the first and second sections being of opposite direction thread lead.

5. The workholder of claim 1, wherein the wedge block has a top center rib formed by shoulder surfaces on opposite side of the rib, one side of the rib having workpiece engaging members extending from the side of the rib, and a portion of the wedge slide moving outwardly from the opposite side of the rib when the wedge slide moves toward the bore shoulder.

6. The workholder of claim 5, wherein the workpiece engaging members comprise headed stops threaded into the rib and having heads with serrated end surfaces for engaging a workpiece.

7. The workholder of claim 5, wherein the shoulder surfaces forming the center rib are parallel to the base support plane, and at least one locating pad on each of the shoulder surfaces, the locating pad having a head with an end surface forming a support for a workpiece to be clamped.

8. The workholder of claim 1, wherein the wedge slide is a unitary body having a cylindrical shank slidable in the bore of the wedge block, and a lateral key portion extending into the guide slot, the key portion being formed by a recess formed therein with a recess surface substantially perpendicular to the base support plane of the wedge block when the cylindrical shank is in the wedge block bore.

9. The workholder of claim 8 and a bore in the wedge slide portion opening to the recess surface adjacent an upper portion thereof, the jaw comprising a cylindrical member having one flat side slidably mounted in the cross bore, the flat side engaging a workpiece to be clamped.

10. A workholder including a wedge block having a bore therein positioned with an axis of the bore at an acute angle relative to a base support plane of the wedge block;

a slot formed in said wedge block and intersecting said bore along one side of the bore, such that there is a lateral opening to the bore;

a wedge slide slidably mounted in said bore having a jaw for engaging a workpiece, extending through the lateral opening sufficiently to engage a workpiece to be clamped outwardly of the bore, the wedge slide having a guide section slidably mounted in and substantially closing said slot and positioned on a side of the jaw toward the base support plane; and an actuator to move said wedge slide in said bore toward the support plane.

11. The workholder of claim 10 wherein said bore has an inner shoulder surface and a spring for urging the wedge slide away from the shoulder surface.

12. The workholder of claim 11, wherein the actuator comprises a screw passing through an opening in said wedge slide and threadably engaging a threaded opening in the wedge block.

13. The workholder of claim 10 wherein the actuator comprises a screw having first and second threaded sections of opposite thread lead, one of the sections being threaded into a threaded section of the bore in the wedge block and the other threaded section being threaded into an aligning bore in the wedge slide.

14. A workholder including a wedge block having a bore therein positioned with an axis of the bore at an acute angle relative to a base support plane of the wedge block;

a slot formed in said wedge block and intersecting said bore along one side of the bore, such that there is a lateral opening to the bore;

a wedge slide slidably mounted in said bore having a jaw for engaging a workpiece extending through the lateral opening sufficiently to engage a workpiece to be clamped outwardly of the bore; and an actuator to move said wedge slide in said bore toward the base support plane, and wherein the wedge block has a top center rib formed by shoulder surfaces on opposite sides of the rib, one side of the rib having a pair of workpiece engaging members extending from the one side of the rib and the jaw of the wedge slide moving outwardly from a side of the rib opposite the one side when the wedge slide moves toward the base support plane.

15. The workholder of claim 14, wherein the workpiece engaging members comprise headed stops threaded into the rib and having heads with serrated end surfaces for engaging a workpiece.

16. The workholder of claim 14, wherein the shoulder surfaces forming the center rib are parallel to the base support plane, and one locating pad on one shoulder surface in a mid-portion of the one shoulder surface, and a pair of spaced locating pads on the other shoulder surface to provide a three point support on a plane parallel to the base support plane, the locating pads having a head with an end surface forming a support for a workpiece to be clamped.

17. The workholder of claim 10 wherein said bore has an internal shoulder extending laterally to the axis of the bore and opening to the slot, the guide section providing a protective shield for said internal shoulder when a main portion of the wedge slide is spaced from the internal shoulder.

18. The workholder of claim 10 wherein said bore has an inner shoulder surface, and said slot in the wedge block extends toward the base support plane beyond the inner shoulder surface, said guide section sliding along the slot and extending in the slot toward the base support plane a selected distance to provide a shield for the inner shoulder surface as the wedge slide moves away from the inner shoulder surface a selected amount.

* * * * *